US007231671B2

(12) United States Patent
Allen

(10) Patent No.: US 7,231,671 B2
(45) Date of Patent: Jun. 19, 2007

(54) ADJUSTABLE LEG WIDTH TROUSERS

(76) Inventor: Bradley Allen, 29 Idaho Ave., Newark, OH (US) 43055

( * ) Notice: Subject to any disclaimer, the term of this patent is extended or adjusted under 35 U.S.C. 154(b) by 111 days.

(21) Appl. No.: 11/061,340

(22) Filed: Feb. 18, 2005

(65) Prior Publication Data

US 2006/0185065 A1 Aug. 24, 2006

(51) Int. Cl.
*A41D 1/06* (2006.01)

(52) U.S. Cl. ..... 2/227; 2/232; 2/270

(58) Field of Classification Search ..... 2/79, 2/227, 269, 270, 232, 233, DIG. 1
See application file for complete search history.

(56) References Cited

U.S. PATENT DOCUMENTS

| | | | | | |
|---|---|---|---|---|---|
| 841,824 | A | * | 1/1907 | Sweet | 2/227 |
| 1,641,487 | A | | 9/1927 | Hockmeyer | |
| 1,691,057 | A | | 11/1928 | Greilich | |
| 1,861,383 | A | | 5/1932 | Ficcio | |
| 1,861,704 | A | * | 6/1932 | Manke | 2/227 |
| 2,079,980 | A | * | 5/1937 | Anders | 2/115 |
| 2,317,768 | A | * | 4/1943 | Holland et al. | 2/227 |
| 2,391,535 | A | | 12/1945 | Zelano | |
| 2,714,720 | A | * | 8/1955 | Turner, Jr. | 2/227 |
| 2,747,197 | A | * | 5/1956 | Bailey | 2/211 |
| 4,149,273 | A | | 4/1979 | Lazor | |
| 4,494,248 | A | | 1/1985 | Holder | |
| 4,683,595 | A | | 8/1987 | Cash | |
| 4,985,936 | A | * | 1/1991 | Jones | 2/269 |
| 5,035,007 | A | | 7/1991 | Grilliot | |
| 5,708,977 | A | * | 1/1998 | Morkunas | 2/80 |
| 5,794,267 | A | | 8/1998 | Wallace | |
| 5,946,730 | A | | 9/1999 | Blair | |
| 6,119,274 | A | | 9/2000 | Graham | |
| 6,611,964 | B2 | | 9/2003 | Lipsett et al. | |

OTHER PUBLICATIONS

"How To Make Your Own Flares"; http://web.archive.org/web/20021014032424/http://bigflares.com/howto.htm; pp. 1-3; Oct. 14, 2002.*

"How To Make Your Own Flares"; http://www.bigflares.com/howto.htm; pp. 1-3; Dec. 12, 2006.*

* cited by examiner

*Primary Examiner*—Gary L. Welch
(74) *Attorney, Agent, or Firm*—Gallagher & Dawsey Co., LPA; Michael J. Gallagher; David J. Dawsey

(57) ABSTRACT

Variable leg width trousers, offering the wearer the ability to change the diameter of the lower leg sections of the trousers near the foot end while keeping the diameter of the upper leg sections constant. Each lower leg section is formed to have a width adjustment slot. The trousers may include a width adjusting insert, releasably attached to the lower leg sections by at least one joining device for each width adjustment slot, with which to vary the size of the width adjusting inserts. This allows the user to select the contraction or expansion of each lower leg section for functionality or appearance. The inserts may be constructed of the same material as the trousers or may be constructed of contrasting materials and/or colors. The width adjusting inserts may incorporate decorative indicia or expressive indicia, or may bear certain functional features, such as reflectors or pockets.

10 Claims, 9 Drawing Sheets

ADJUSTABLE LEG WIDTH TROUSERS

TECHNICAL FIELD

The present invention relates to the field of adjustable clothing, in particular, to means for creating a variable leg width trousers by expanding the lower leg portion of clothing with inserts of varying sizes and types.

BACKGROUND OF THE INVENTION

While it is clear that the human leg generally tapers from thigh to calf, and therefore that most lower body trousers or leggings will follow the narrowing width towards the foot, nonetheless there are circumstances where such a width is inconvenient or even dangerous. Additionally, there is often a fashion desire to reverse the visual appearance of the traditional taper, as is seen, for example, in so-called bell bottom pants, in which the diameter of the lower leg portion of the trousers may be significantly larger than expected, sometimes even larger than the thigh portion of the same garment. Throughout this description, it is intended that the word "trousers," shall mean pants, leggings, or any other covering that covers one or both of the lower aspects of the leg.

For example, the traditional narrowing width makes it difficult, if not impossible, to put trousers or leggings on over boots or shoes. Early attempts to accommodate such are seen in U.S. Pat. Nos. 1,641,487 ('487) and 1,691,057 ('057). Each has distinct drawbacks. For example, the stretch panel of the '057 device has a necessarily limited range of accommodation, while the zippered closure of the '487 device is entirely fixed in the diameter of footwear that it might close around.

Other attempts have been made that avoid the traditional width relationship of pants. In U.S. Pat. No. 4,149,273 ('273), an entirely open lateral aspect of a trousers leg allows open expansion, but fails to prevent the trousers leg from flapping uncontrollably, or more dangerously, from becoming entangled on various objects. The firefighter's trousers of U.S. Pat. No. 5,035,007 ('007) utilize a zippered closure over an expansive area in which the zipper may be opened to allow expansion of the pant leg. This system causes additional bulk to the garment and is subject to the vagaries of any zippered closure.

The aforementioned articles of clothing, in their limited ways, have attempted to solve the structural limitations of traditionally tapered pants. However, there has been little or no effort to address the fashion aspects of such clothing. For example, the past art has generally provided for either an expanded or a contracted position, and not allowed for variability in the degree of displayed width. This is contrary to general fashion sense, in which the wearer is likely to want to vary the width from time to time. Additionally, past art has generally failed to use inserts to vary the width achieved, or has failed to appreciate the effects that may be gained by having inserts of different textures or materials, or inserts bearing certain decorative indicia, or even inserts bearing certain functional features, such as reflectors or pockets.

In short, the prior art has failed to provide a trousers or leggings design that allows for variable width, decoratively or functionally different materials compared to that of the main body of the trousers or leggings, or decorative or functional features that may be varied as part of the width varying mechanism. The present invention solves all these problems.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

The adjustable leg width trousers of the present invention are configured to be worn over the lower part of a human body including the legs and a portion of the torso. The trousers include a waistband, a trunk section, and a pair of leg sections. The trunk section is designed to cover a portion of the torso and is connected to the waistband at one end and the leg sections at the other end.

Each leg section has a foot end that is nearest the foot of a person wearing the trousers, and a crotch end that is at the opposite end of the leg sections nearest the trunk section. One novel feature of the present invention is the ability to change the diameter of the leg sections at the foot end while keeping the diameter of the leg sections constant from the knee to the crotch end. Each leg section has a lower leg section starting approximately midway between the foot end and the crotch end and extending to the foot end. To allow for the previously mentioned adjustability of the foot end diameter, each lower leg section is formed to have a width adjustment slot.

The trousers may include a width adjusting insert for each width adjustment slot. By varying the size of the width adjusting inserts the wearer of the trousers can change the foot end diameter. This allows the user to select the contraction or expansion of each lower leg section for functionality or appearance. The width adjusting inserts are releasably attached to the lower leg sections by at least one joining device. As one with skill in the art will recognize, any number of commercially available joining devices may be utilized in the present invention.

The width adjusting inserts may be constructed of the same material as the trousers to match, or blend into, the trousers, or the inserts may be constructed of contrasting materials and/or colors to visually set them apart from the remainder of the trousers. Further, the width adjusting inserts may incorporate decorative indicia or expressive indicia, such as school or team colors and logos. Inserts may bear certain functional features, such as reflectors or pockets.

These variations, modifications, alternatives, and alterations of the various preferred embodiments may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DETAILED DESCRIPTION OF THE INVENTION

The adjustable leg width trousers (10) of the instant invention enables a significant advance in the state of the art. The preferred embodiments of the trousers (10) accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
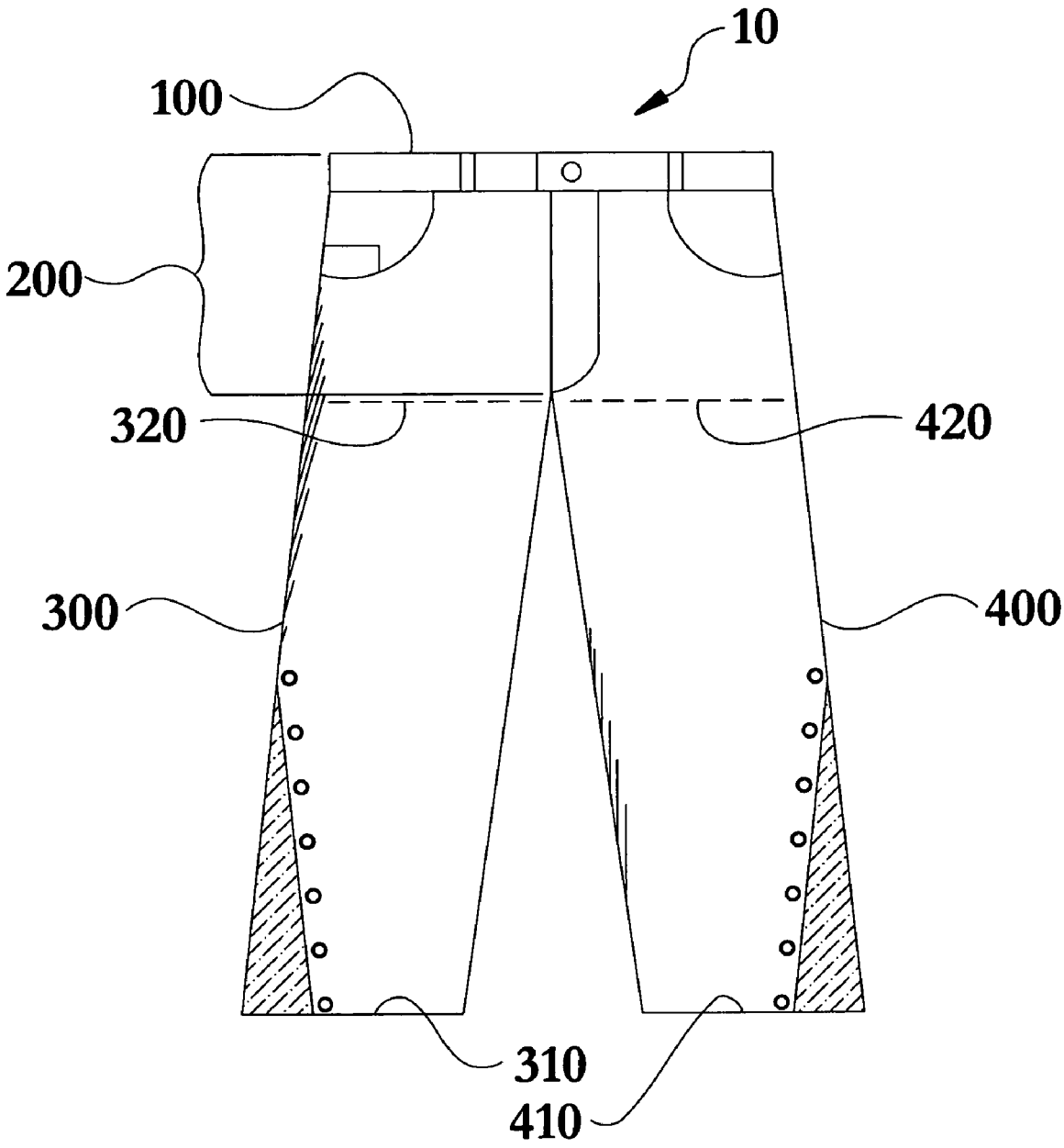
FIG. 1 shows a front elevation view of the adjustable leg width trousers of the present invention, not to scale.

The adjustable leg width trousers (10) of the present invention are configured to be worn over the lower part of a human body including the legs and a portion of the torso. The trousers (10) include a waistband (100), a trunk section (200), and a pair of leg sections including a right leg section (300) and a left leg section (400), as seen in FIG. 1. The trunk section (200) is designed to cover a portion of the torso and is connected to the waistband (100) at one end and the leg sections (300, 400) at the other end.

Figure 2:
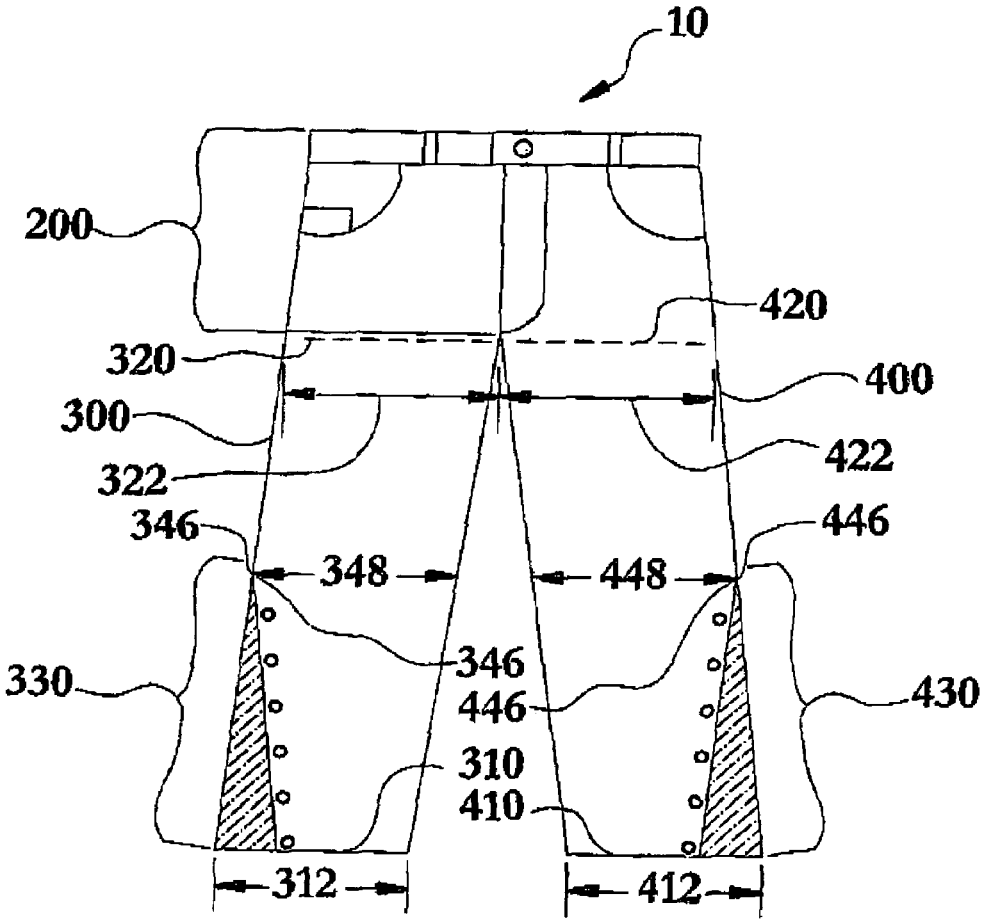
FIG. 2 shows a front elevation view of the adjustable leg width trousers of the present invention, not to scale.

Each leg section has a foot end (310, 410) that is nearest the foot of a human wearing the trousers (10), and a crotch end (320, 420) that is at the opposite end of the leg sections (300, 400) nearest the trunk section (200). One novel feature of the present invention is the ability to change the diameter of the leg sections (300, 400) at the foot end (310, 410). Therefore, to ease explanation of the invention, each leg section (300, 400) has at least three distinct locations at which the diameter of the leg section (300, 400) is referenced, as seen in FIG. 2. First, each leg section (300, 400) has a foot end diameter (312, 412) at the foot end (310, 410). Secondly, each leg section (300, 400) has a crotch end diameter (322, 422) at a crotch end (320, 420) of each leg section (300, 400). It is at the crotch end (320, 420) that each leg section (300, 400) is connected to the trunk section (200). Thirdly, each leg section (300, 400) has a vertex diameter (348, 448), which will be explained in more detail later herein.

Figure 3:
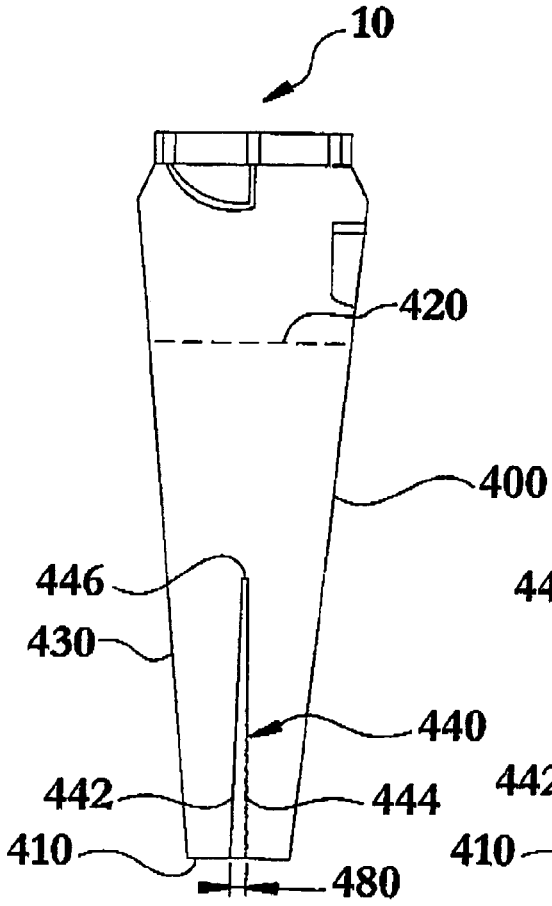
FIG. 3 shows a left side elevation view of the adjustable leg width trousers of the present invention, not to scale.
Figure 4:
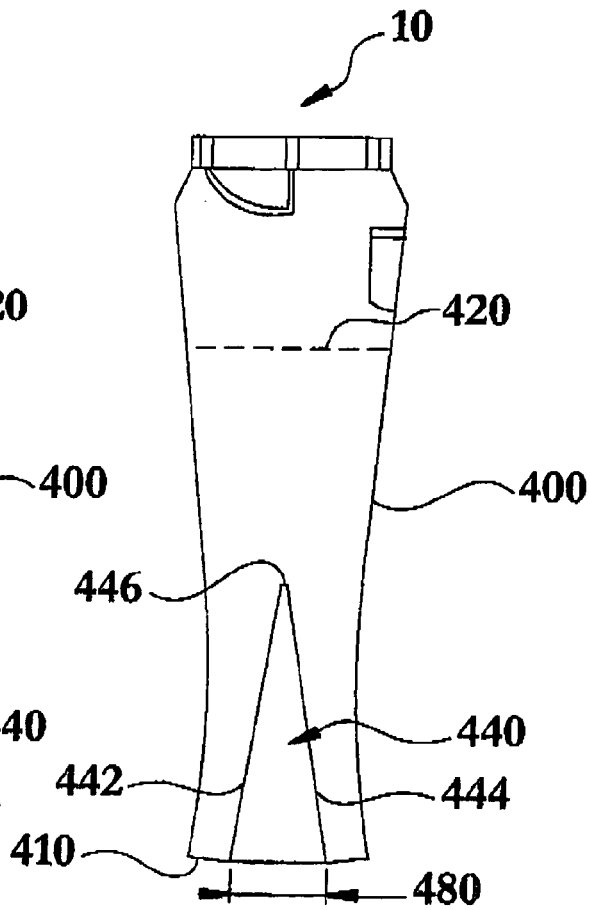
FIG. 4 shows a left side elevation view of the adjustable leg width trousers of the present invention, not to scale.
Figure 5:
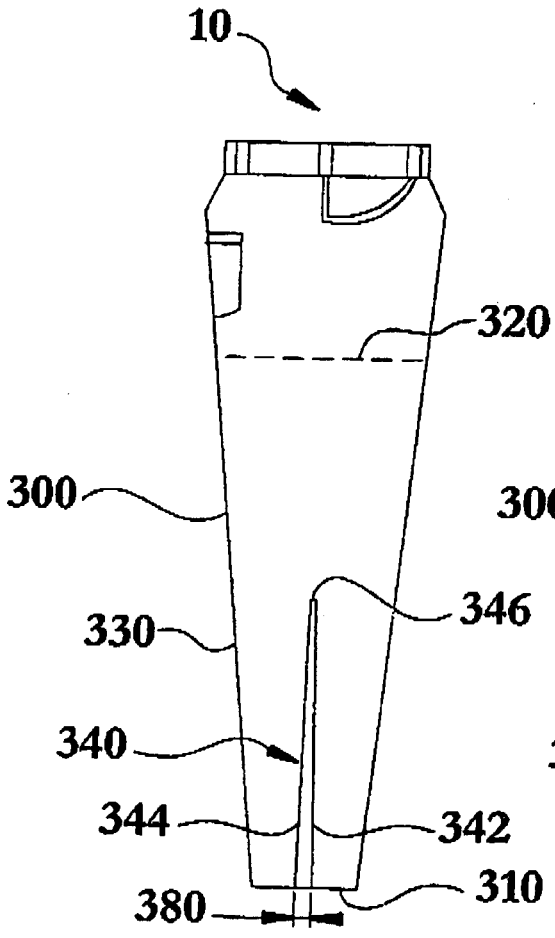
FIG. 5 shows a right side elevation view of the adjustable leg width trousers of the present invention, not to scale.
Figure 6:
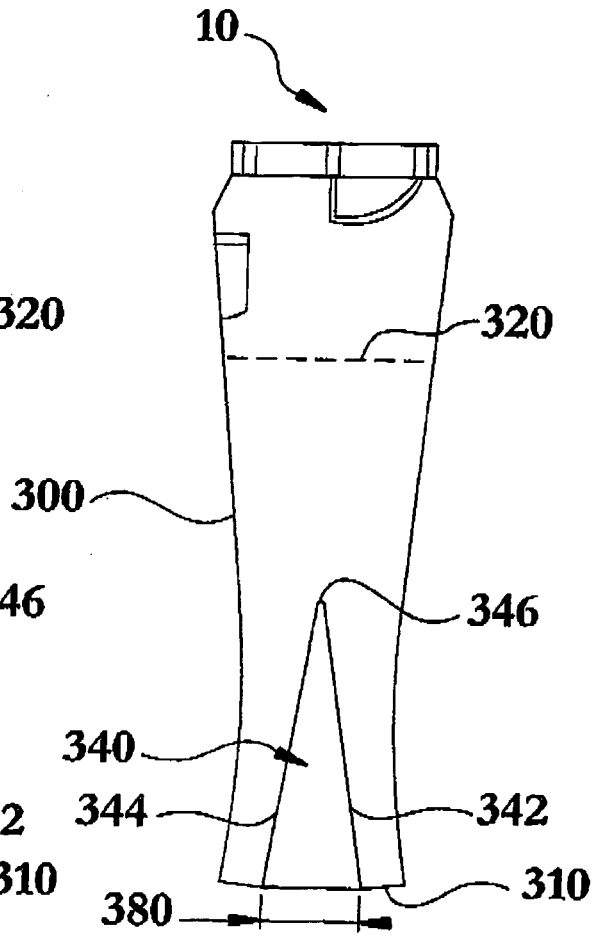
FIG. 6 shows a right side elevation view of the adjustable leg width trousers of the present invention, not to scale.

Each leg section (300, 400) has a lower leg section (330, 430), labeled in FIG. 2, starting approximately midway between the foot end (310, 410) and the crotch end (320, 420) and extending to the foot end (310, 410). To allow for the previously mentioned adjustability of the foot end diameter (312, 412) each lower leg section (330, 430) is formed to have a width adjustment slot (340, 440) having at least a first slot edge (342, 442) and a second slot edge (344, 444), seen in FIGS. 3 and 5 with the width adjustment slots (340, 440) nearly closed and seen in FIGS. 4 and 6, with the width adjustment slots (340, 440) substantially open. The first slot edges (342, 442) and the second slot edges (344, 444) extend from the foot end (310, 410) toward the crotch end (320, 420) and terminating at a slot vertex (346, 446). It is at these slot vertices (346, 446) that the previously referenced vertex diameters (348, 448) of the leg sections (300, 400) are located, as seen in FIG. 2. It is important to note that while each leg section (300, 400) includes at least one width adjustment slot (340, 440), each leg section (300, 400) may incorporate multiple width adjustment slots (340, 440).

The trousers (10) may include a width adjusting insert (350, 450) for each width adjustment slot (340, 440) having an insert perimeter (352, 452) and an insert shape (354, 454), as seen in FIGS. 7, 8, 9, and 10. Such width adjusting inserts (350, 450) are designed to be releasably attached to the lower leg sections (330, 430) to separate the first slot edge (342, 442) and the second slot edge (344, 444). By varying the size of the width adjusting inserts (350, 450) the wearer of the trousers (10) can separate the first slot edge (342, 442) and the second slot edge (344, 444) at the foot end (310, 410) by a predetermined slot opening distance (380, 480), thereby changing the foot end diameter (312, 412) while the vertex diameter (348, 448) remains unchanged. This allows the user to select the contraction or expansion of each lower leg section (330, 430) for functionality or appearance.

Figure 7:
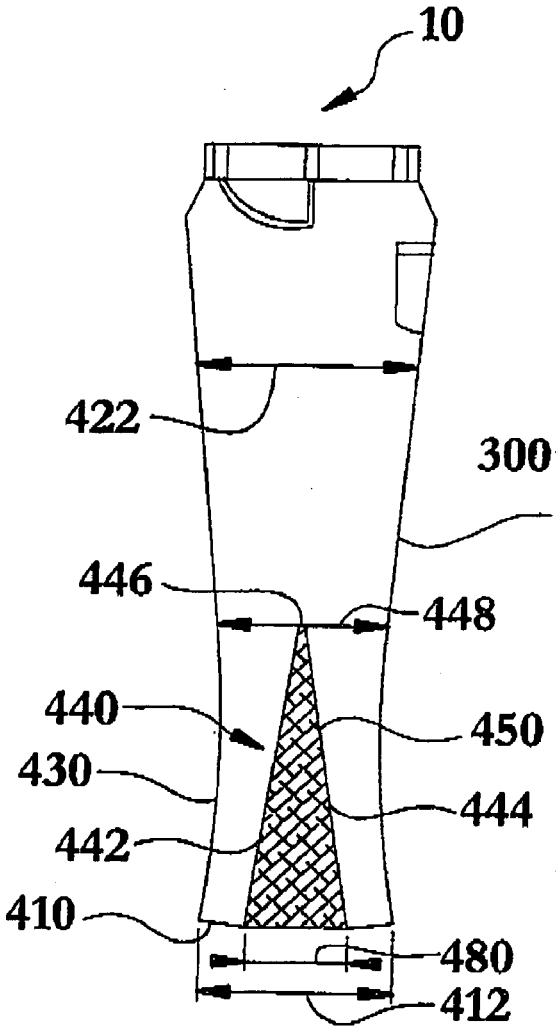
FIG. 7 shows a left side elevation view of the adjustable leg width trousers of the present invention, not to scale.
Figure 8:
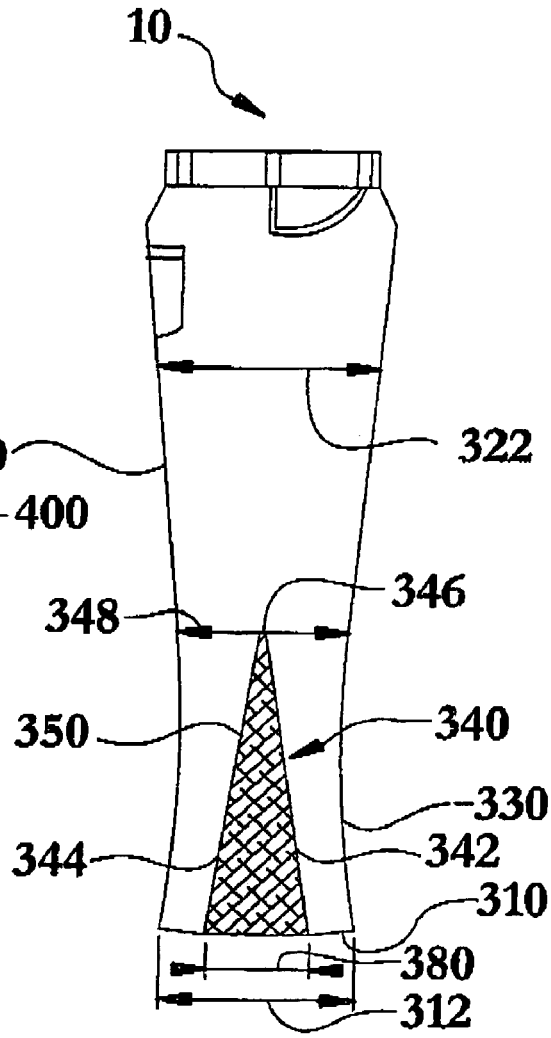
FIG. 8 shows a right side elevation view of the adjustable leg width trousers of the present invention, not to scale.
Figure 9:
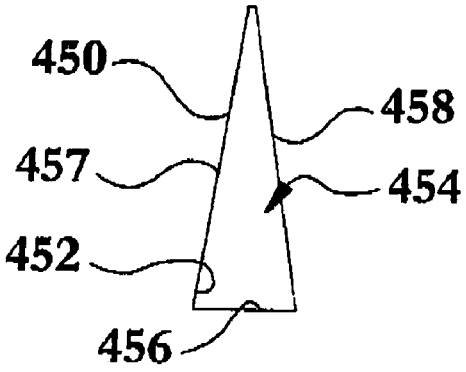
FIG. 9 shows a left side width adjusting insert of the present invention in elevation view, not to scale.
Figure 10:
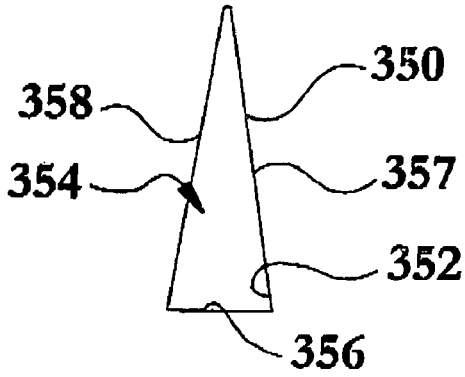
FIG. 10 shows a right side width adjusting insert of the present invention in elevation view, not to scale.

In one particular embodiment of the instant invention, as seen in FIGS. 7 and 8, the trousers (10) have a "bell bottom"

appearance, as is known in the art. In this embodiment, the foot end diameters (312, 412) are approximately greater than the vertex diameters (348, 448). To attain this appearance, the width adjusting insert (350, 450) are inserted into the width adjustment slots (340, 440) which allows the foot end diameter (312, 412) to expand while the Vertex diameter (348, 448) remains unchanged. Therefore, a slope running from the crotch diameter (322, 422), seen only in FIG. 1, to the Vertex diameter (348, 448) would be different from a slope running from the vertex diameter (348, 448) to the foot end diameter (312, 412) as seen in FIGS. 7 and 8. As one skilled in the art will recognize, the change in the slopes of the trouser may be gradual end continuous providing a more fluid profile, or it may be discontinuous or abrupt as style may dictate.

Figure 11:
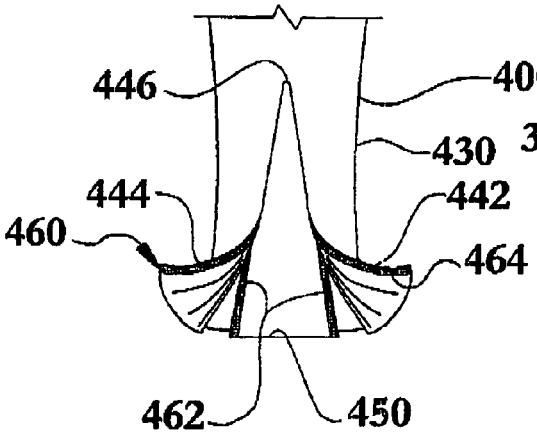
FIG. 11 shows a left side lower leg section of the present invention in elevation view, not to scale.
Figure 12:
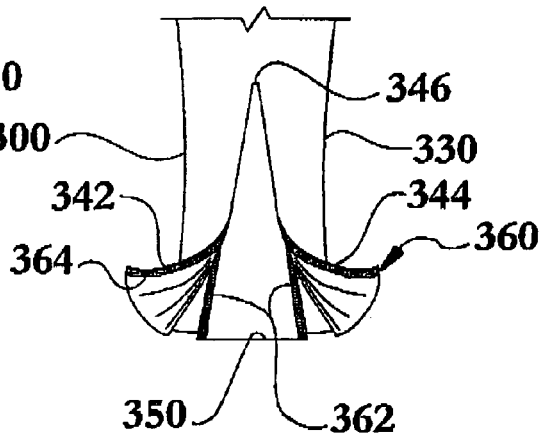
FIG. 12 shows a right side lower leg section of the present invention in elevation view, not to scale.
Figure 13:
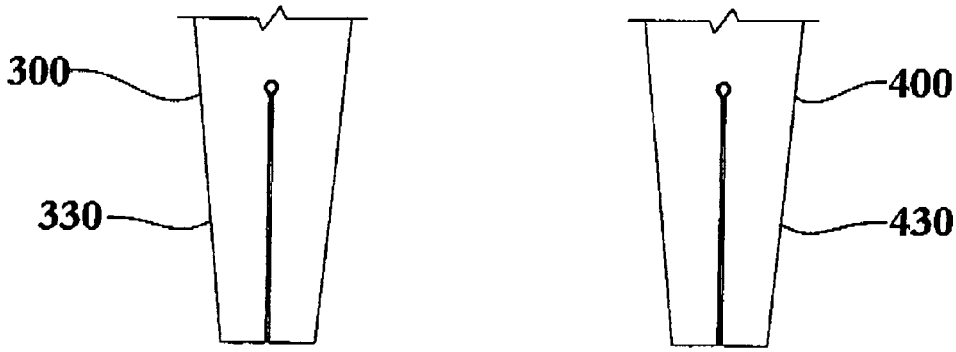
FIG. 13 shows a right side lower leg section and a left side lower leg section of the present invention in elevation view, not to scale.

The width adjusting inserts (350, 450) are releasably attached to the lower leg sections (330, 430) by at least one joining device (360, 460), as seen in FIGS. 11 and 12. The at least one joining devices (360, 460) are configured to provide for the releasable attachment of the first slot edge (342, 442) to the second slot edge (344, 444) in the absence of the width adjusting insert (350, 450). Therefore, when the width adjusting inserts (350, 450) are not in place the lower leg sections (330, 430) of the trousers (10) of the present invention appear substantially the same as the lower leg sections of traditional non-adjustable leg width trousers, as seen in FIG. 13.

Figure 14:
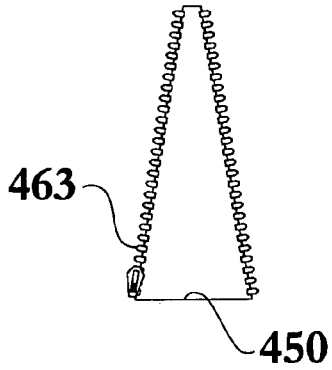
FIG. 14 shows a left side width adjusting insert of the present invention in elevation view, not to scale.
Figure 15:
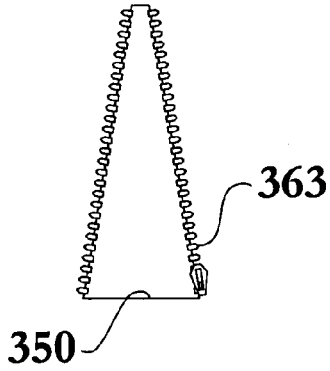
FIG. 15 shows a right side width adjusting insert of the present invention in elevation view, not to scale.
Figure 16:
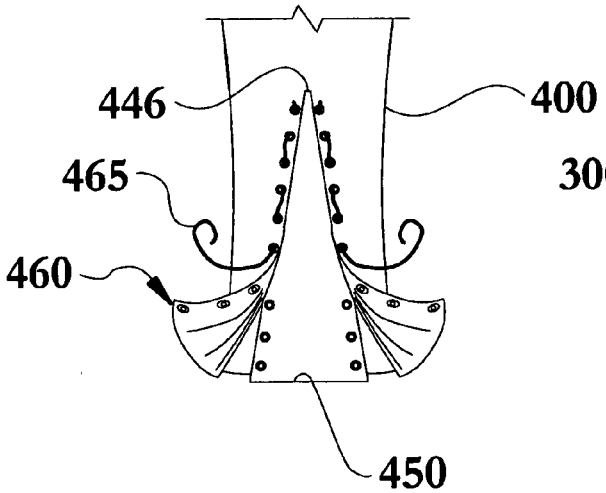
FIG. 16 shows a left side lower leg section of the present invention in elevation view, not to scale.
Figure 17:
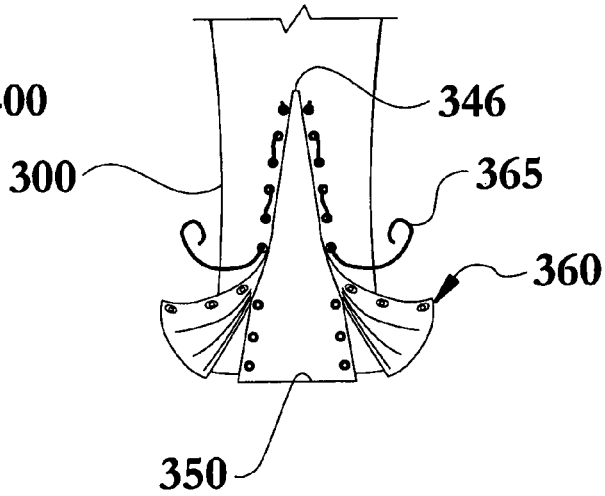
FIG. 17 shows a right side lower leg section of the present invention in elevation view, not to scale.
Figure 18:
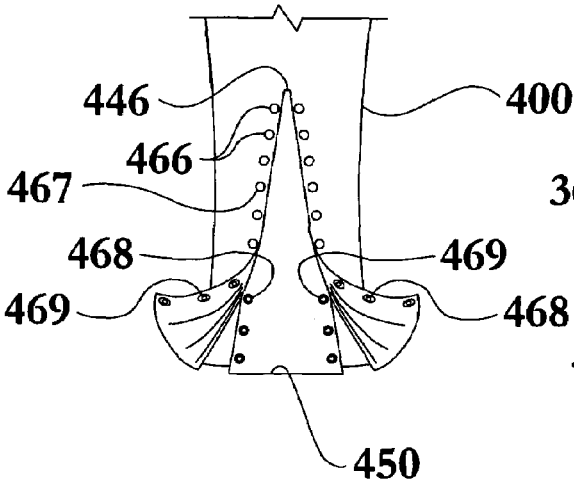
FIG. 18 shows a left side lower leg section of the present invention in elevation view, not to scale.
Figure 19:
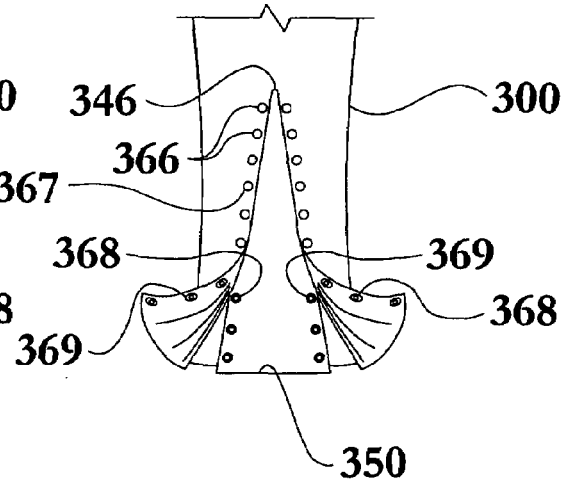
FIG. 19 shows a right side lower leg section of the present invention in elevation view, not to scale.
Figure 20:
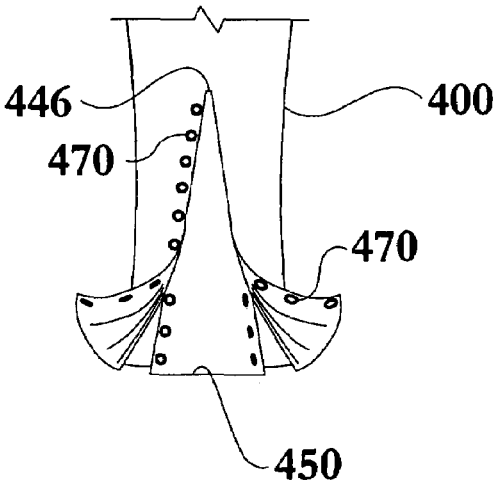
FIG. 20 shows a left side lower leg section of the present invention in elevation view, not to scale.
Figure 21:
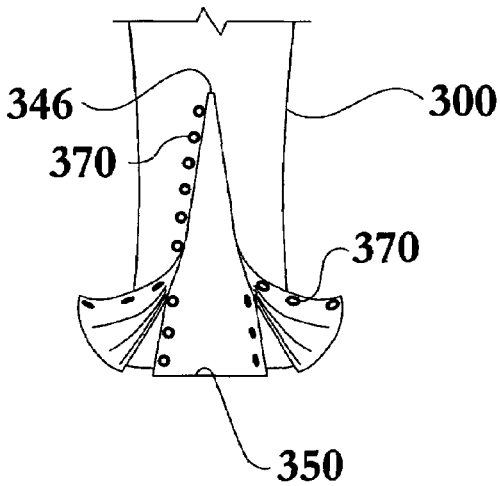
FIG. 21 shows a right side lower leg section of the present invention in elevation view, not to scale.
Figure 22:
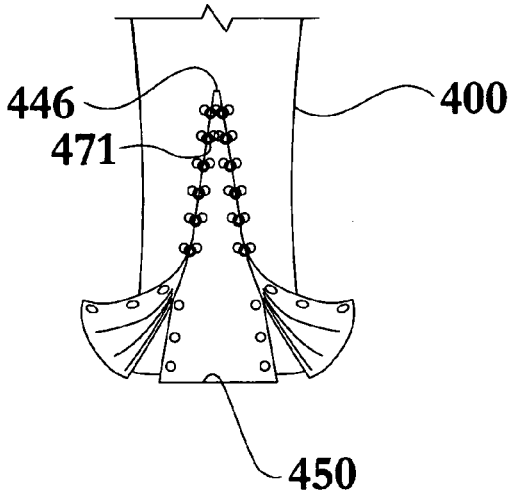
FIG. 22 shows a left side lower leg section of the present invention in elevation view, not to scale.
Figure 23:
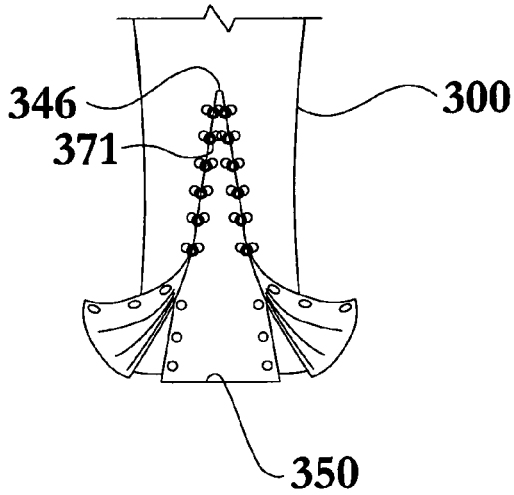
FIG. 23 shows a right side lower leg section of the present invention in elevation view, not to scale.

As one with skill in the art will recognize, any number of commercially available joining devices (360, 460) may be utilized in the present invention. In one particular embodiment the joining devices (360, 460) of each leg section (300, 400) are continuous fasteners (362, 462) for each first slot edge (342, 442) and each second slot edge (344, 444), as seen in FIGS. 11 and 12. Variations of continuous fasteners (362, 462) includes zippers (363, 463), as seen in FIGS. 14 and 15, hook and loop fastener systems (364, 464), as Seen in FIGS. 11 and 12, and laces (365; 465), as seen in FIG. 16 and 17. In alternative embodiments, as seen in FIGS. 18-23, the at least one joining device (360, 460) of each leg (300, 400) maybe a plurality of individual attachment devices (366, 466). Variations of individual attachment devices (366, 466) include (a) snaps (367, 467) having cooperating male sections (368, 468) and female sections (369, 469), as seen FIGS. 18 and 19 (b) buttons (370, 470), as seen in FIGS. 20 and 21, and (c) clips (371, 471), as seen in FIGS. 22 and 23.

Figure 24:
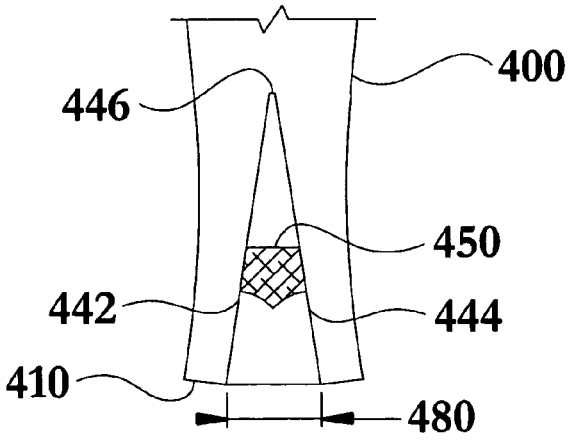
FIG. 24 shows a left side lower leg section of the present invention in elevation view, not to scale.
Figure 25:
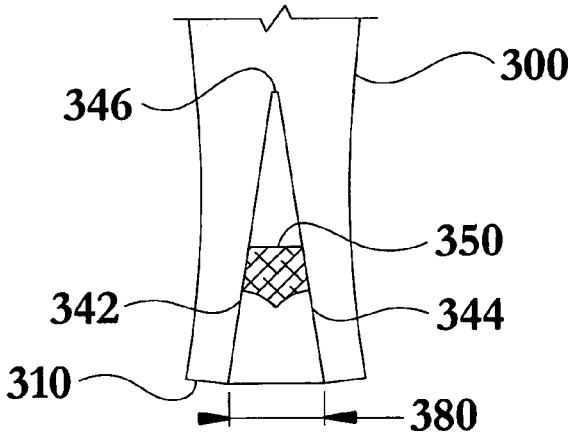
FIG. 25 shows a right side lower leg section of the present invention in elevation view, not to scale.

In some embodiments, the width adjusting inserts (350, 450) completely fill the area between the first slot edges (342, 442) and the second slot edges (344, 444) from the foot end (310, 410) of each leg section (300, 400) to the slot vertex (346, 446), as seen in FIGS. 7, 8, 9, and 10. In this particular embodiment the insert shapes (354, 454) are substantially triangular having a base edge (356, 456), a first insert edge (357, 457), and a second insert edge (358, 458). Alternatively, in other embodiments, the width adjusting inserts (350, 450) do not completely fill the area between the first slot edges (342, 442) and the second slot edges (344, 444) from the foot end (310, 410) of each leg section (300, 400) to the slot vertex (346, 446) of each leg section (300, 400), as seen in FIGS. 24 and 25. Changing the size, shape, style, and ornamentation of the width adjusting inserts (350, 450) can greatly change the look and function of the trousers (10).

The width adjusting inserts (350, 450) may be constructed of the same material as the trousers (10) to match, or blend into, the trousers (10), or the inserts (350, 450) may be constructed of contrasting materials and/or colors to visually set them apart from the remainder of the trousers (10). Further, the width adjusting inserts (350, 450) may incorporate decorative indicia or expressive indicia, such as school or team colors and logos. Inserts may bear certain functional features, such as reflectors or pockets.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

I claim:

1. Adjustable leg width trousers configured to be worn over the lower part of a human body including the legs and a portion of the torso, comprising:

(a) a waistband;

(b) a trunk section designed to cover a portion of the torso and being connected to the waistband;

(c) a pair of leg sections including a right leg section and a left leg section with each leg section having;

(1) a foot end having a foot end diameter;

(2) a crotch end having a crotch end diameter wherein the crotch end of each leg section is connected to the trunk section; and (3) a lower leg section starting approximately midway between the foot end and the crotch end and extending to the foot end, having;

(i) a width adjustment slot formed in the lower leg section having at least a first slot edge extending from the foot end toward the crotch end and terminating at a slot vertex and a second slot edge extending from the foot end toward the crotch end and terminating at the slot vertex, thereby establishing a diameter of each leg section at the point of the slot vertex referred to as the vertex diameter;

(ii) a width adjusting insert having an insert perimeter and a substantially triangular insert shape having a base edge, a first insert edge, and a second insert edge, wherein the width adjusting insert does not completely fill the area between the first slot edges and the second slot edges from the foot end of each leg section to the slot vertex of each leg section; and (iii) at least one joining device for releasably attaching the width adjusting insert to the lower leg section thereby establishing the foot end diameter and separating the first slot edge and the second slot edge at the foot end by a predetermined slot opening distance while the vertex diameter remains unchanged, and providing for the releasable attachment of the first slot edge to the second slot edge in the absence of the width adjusting insert.

2. The trousers of claim 1, wherein the at least one joining device of each leg section is a continuous fastener for each first slot edge and each second slot edge.

3. The trousers of claim 2, wherein the continuous fastener is a zipper.

4. The trousers of claim 2, wherein the continuous fastener is a hook and loop fastener system.

5. The trousers of claim 2, wherein the continuous fastener is a lace.

6. The trousers of claim 1, wherein the at least one joining device of each leg is a plurality of individual attachment devices.

7. The trousers of claim 6, wherein the plurality of individual attachment devices are snaps having cooperating male sections and female sections.

8. The trousers of claim 6, wherein the plurality of individual attachment devices are buttons.

9. The trousers of claim 6, wherein the plurality of individual attachment devices are clips.

10. The trousers of claim 1, wherein when the predetermined slot opening distance is greater than zero, the foot end diameter is greater than the vertex diameter.

* * * * *